US008117971B1

(12) United States Patent
Cotton et al.

(10) Patent No.: US 8,117,971 B1
(45) Date of Patent: Feb. 21, 2012

(54) TABLE CLOTH AND TRASH BAG COMBINATION

(76) Inventors: Yettie LaVonne Cotton, Lakewood, CO (US); M. A. Yah Cotton, Lakewood, CO (US)

( * ) Notice: Subject to any disclaimer, the term of this patent is extended or adjusted under 35 U.S.C. 154(b) by 0 days.

(21) Appl. No.: 12/925,330

(22) Filed: Oct. 19, 2010

Related U.S. Application Data

(60) Provisional application No. 61/279,343, filed on Oct. 21, 2009.

(51) Int. Cl.
*A47B 13/08* (2006.01)

(52) U.S. Cl. ..... 108/90; 108/25; 383/4

(58) Field of Classification Search ..... 108/90, 108/25, 26, 27; 150/156, 158; 383/4, 75, 383/76; 53/468
See application file for complete search history.

(56) References Cited

U.S. PATENT DOCUMENTS 4,471,600 A * 9/1984 Dunleavy ..... 53/468
4,747,352 A * 5/1988 Guidry et al. ..... 108/26
4,789,019 A * 12/1988 Sweetser et al. ..... 108/90
4,938,607 A * 7/1990 Kelley ..... 383/4
5,055,081 A * 10/1991 Nayak ..... 108/26
5,069,554 A * 12/1991 Bonnett ..... 383/4
5,572,934 A * 11/1996 Aldridge et al. ..... 108/25
5,765,487 A * 6/1998 Neff ..... 108/90
6,014,935 A * 1/2000 Willett ..... 108/90
6,321,662 B1 * 11/2001 Fraise ..... 108/25
6,808,071 B2 * 10/2004 Brown ..... 108/90
2007/0056482 A1 * 3/2007 Robinson et al. ..... 108/25
2010/0132595 A1 * 6/2010 Gledhill ..... 108/90

* cited by examiner

*Primary Examiner* — Jose V Chen
(74) *Attorney, Agent, or Firm* — Edwin H. Crabtree; Ramon L. Pizarro

(57) ABSTRACT

A table cloth and trash bag combination having a table cloth upper portion dimensioned to be laid on top of a picnic table or other types of outdoor and indoor tables and made of thin sheet paper, plastic and like material. The upper portion includes decorative designs of toys, animals, birthday cakes, logos, and like festive items for birthdays, anniversary, and other party events. On opposite corners of the upper portion is an outwardly extending first portion of pull strings. A second portion of the pull strings is received through seams disposed along sides of a length and a width of the table cloth upper portion. In the center of the table cloth upper portion and parallel to the length is an elongated opening having sides attached to a top of a folded trash bag lower portion. The opening provides access into the folded trash bag lower portion. The lower portion is made of thin sheet plastic for receiving trash items placed on top of the upper portion and picnic table.

13 Claims, 2 Drawing Sheets

TABLE CLOTH AND TRASH BAG COMBINATION

This non-provisional patent application claims the benefit of an earlier provisional patent application No. 61/279,343 filed on Oct. 21, 2009, by the subject inventors, and having a title of "Combination Table Cloth and Trash Bag".

BACKGROUND OF THE INVENTION (a) Field of the Invention

This invention relates to a table cloth and trash bag for receipt on top of a table during a meal or party and more particularly, but not by way of limitation, to a table cloth and trash bag combination used for picnics, parties and outdoor events and having a table cloth upper portion used for receipt on top of the table made of thin sheet paper or plastic and a trash bag lower portion made of thin sheet plastic and used for receiving trash items therein from the table cloth upper portion.

(b) Discussion of Prior Art

Heretofore, a table at an outdoor or indoor event is typically covered with a table cloth prior to serving food items. Upon completion of the event, throw away items are gathered and placed inside a trash bag or carried to a park's nearby trash barrel. The subject invention eliminates the need of having to bring an individual table cloth along with several trash bags to a picnic or party.

SUMMARY OF THE INVENTION

In view of the foregoing, it is a primary objective of the subject invention to provide an inexpensive, table cloth that can be quickly converted into a large trash bag for receiving trash and throw away items at the end of an outdoor event.

Another object of the invention is the table cloth and trash bag combination can be used for a variety of outdoor events and can be used equally well for indoor events, mess halls, and the like for quickly disposing of throw away trash items.

The subject table cloth and trash bag combination includes a table cloth upper portion dimensioned to be laid on top of a picnic table or other types of outdoor and indoor tables and made of thin sheet paper, plastic and like material. The upper portion includes decorative designs of toys, animals, birthday cakes, logos, and like festive items for birthdays, anniversary, and other party events. On opposite corners of the upper portion are pull strings received through seams disposed along sides of a length and a width of the table cloth upper portion. In the center of the table cloth upper portion and parallel to the length is an elongated opening having sides attached to the sides of a top of a folded trash bag lower portion. The opening provides access into the folded trash bag lower portion. The lower portion is made of thin sheet plastic for receiving trash items placed on top of the upper portion and picnic table. Also, the thin sheet upper portion can be folded and stuffed into the trash bag lower portion. These and other objects of the present invention will become apparent to those familiar with picnic table cloths and plastic trash bags when reviewing the following detailed description, showing novel construction, combination, and elements as herein described, and more particularly defined by the claims, it being understood that changes in the embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments in the present invention according to the best modes presently devised for the practical application of the table cloth and trash bag combination, and in which.

DETAILED DESCRIPTION OF THE PREFERRED EMBODIMENTS

Figure 1:
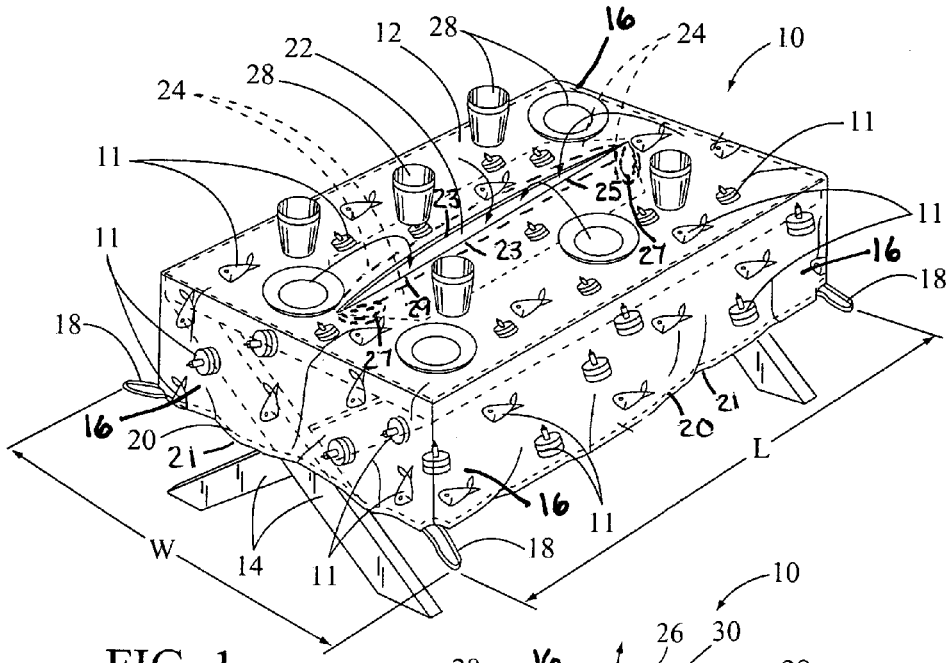
FIG. 1 illustrates a perspective view of the subject table cloth and trash bag combination disposed on top of a picnic table with party plates and cups disposed thereon.

In FIG. 1, a perspective view of the subject table cloth and trash bag combination is shown having a general reference numeral 10. The table cloth and trash bag combination 10 includes a table cloth upper portion 12 dimensioned to be laid on top of a picnic table 14 or other types of outdoor and indoor tables and made of thin sheet paper, thin sheet plastic and similar material. The table cloth upper portion 12 typically has a length "L" in a range of 6 to 8 feet and a width "W" in a range of 4 to 6 feet. Also, the table cloth upper portion can be round and other geometric shapes for different sizes and designs of table tops. The upper portion 12 includes decorative designs of toys, animals, birthday cakes, logos, and like festive items for birthdays, anniversary, and other party events.

On opposite corners 16 of the upper portion 12 is a first portion of pull strings 18 extending outwardly therefrom. The pull strings 18 can be made of plastic, cord and the like. A second portion of the pull strings 18 is received through heat sealed seams 20, shown in dashed lines and disposed along sides 21 of the length "L" and the width "W" of the table cloth upper portion 12.

In the center of the table cloth upper portion 12 and parallel to the length "L" is an elongated bag opening 22. A length of the bag opening 22 can be in a range of 2 to 4 feet. The opening 22 includes sides 23, which can be heat sealed to a top 25 of a folded trash bag lower portion 24. The bag opening 22 provides access into the folded trash bag lower portion 24, shown in dashed lines and laying flush on top of the table 14. The lower portion 24 is made of thin sheet plastic and is shown unfolded in FIGS. 2 and 3 for receiving trash items placed on top of the upper portion 12 and the picnic table 14. Also, the top 25 of the trash bag lower portion 24 includes plastic, pull strings 27 received inside heat sealed seams, shown in dashed lines 29.

Figure 2:
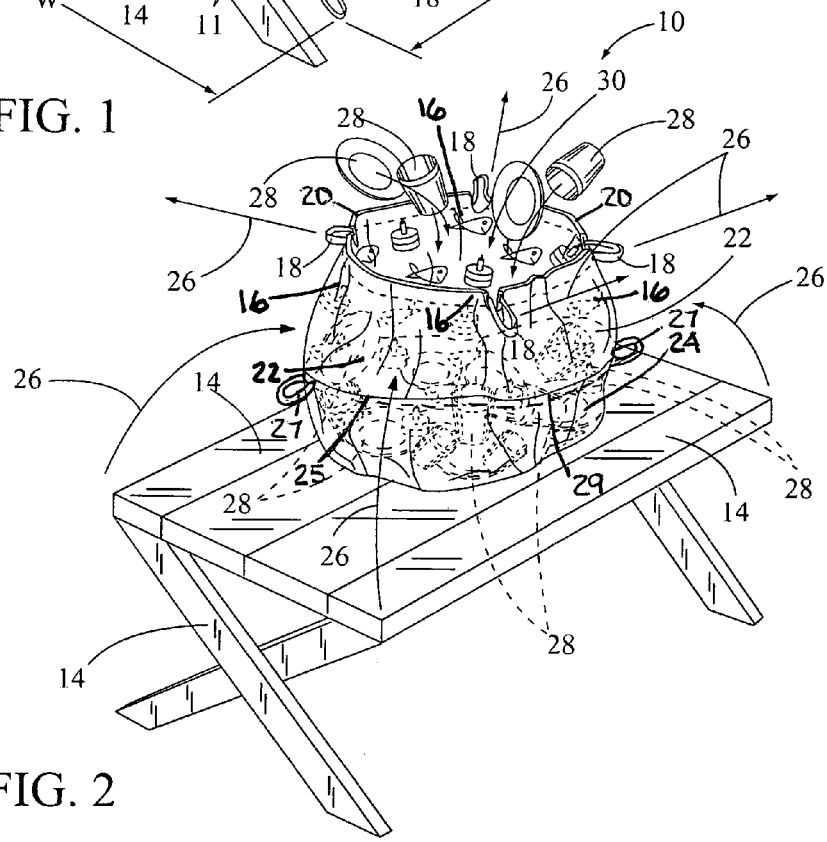
FIG. 2 is another perspective view of the table cloth and trash bag combination with corners of a table cloth upper portion folded upwardly for receiving trash items inside an unfolded trash bag lower portion and after the meal or party is completed.

In FIG. 2, the subject invention 10 is now used as a trash bag by folding the corners 16 of the table cloth upper portion 12 upwardly, as indicated by arrows 26, and spreading apart the elongated opening 22 and unfolding the trash bag lower portion 22. The upper portion 12 is now used to funnel trash items 28 into the opening 22. The various trash items 28 are shown in solid and dashed lines. When all of the throw away items 28 are received inside the trash bag lower portion 24, the pull strings 18 are pulled upwardly and an open top 30 in the table cloth and trash bag 10 is formed. By continuing to pull on the pull strings 18, the opposite corners 16 of the upper portion 22 are drawn together.

Also, another embodiment of the table cloth and trash bag combination 10 is the use of the pull strings 27 of the trash bag lower portion 24. In this embodiment, the table cloth upper portion 12 is folded into the lower portion 24, along with the trash items 28. The pull strings 27 are then pulled tight for closing the top of the lower portion 24.

Figure 3:
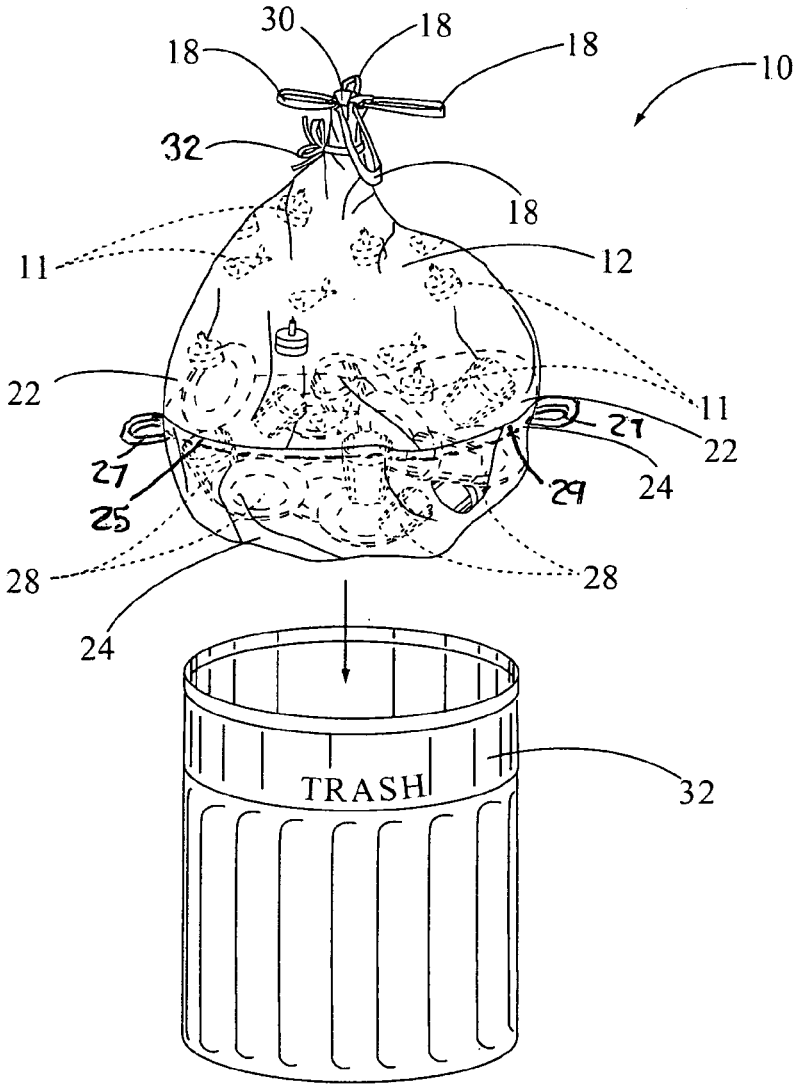
FIG. 3 is a perspective view of the table cloth and trash bag combination with an open top in the bag combination closed using pull strings and a cord tie. The trash bag is now ready for receipt in a trash barrel.

In FIG. 3, the open top 30 is closed using the pull strings 18 and a cord tie 32 is wrapped around the upper portion 16 next to the open top 30 for securing the trash items 28 inside the table cloth and trash bag 10. The bag is now ready for disposable in a trash barrel or other trash receptacle.

While the invention has been particularly shown, described and illustrated in detail with reference to the preferred embodiments and modifications thereof, it should be understood by those skilled in the art that equivalent changes in form and detail may be made therein without departing from the true spirit and scope of the invention as claimed except as precluded by the prior art.

The embodiments of the invention for which as exclusive privilege and property right is claimed are defined as follows:

1. A table cloth and trash bag combination adapted for receipt on a table and receiving trash items therein after a meal, picnic or party is finished, the combination comprising:

a table cloth upper portion, a length and a width of the table cloth upper portion adapted for covering the table;

first pull strings, a first portion of the first pull strings extending outwardly from corners of the table cloth upper portion, a second portion of the first pull strings received inside seams, the seams disposed along sides of the length and the width of the table cloth upper portion;

a folded trash bag lower portion, the trash bag lower portion having an elongated bag opening in a top thereof, the bag opening centered on the table cloth upper portion, sides next to the bag opening attached to the table cloth upper portion;

whereby when corners of the table cloth upper portion are lifted upwardly, the elongated bag opening provides access into an unfolded trash bag lower portion for receiving trash items, whereby when the first pull strings are pulled tight, the trash items are held therein; and second pull strings, a first portion of the second pull strings extending outwardly from opposite ends of the trash bag lower portion and next to the bag opening, a second portion of the second pull strings received inside seams next to the bag opening, the seams disposed along sides of the bag opening;

whereby when the table cloth upper portion with trash items thereon is lifted and received inside the trash bag lower portion, the second pull strings are pulled tight, thereby closing the top of the trash bag lower portion for disposal of the table cloth and trash bag combination.

2. The combination as described in claim 1 wherein the table cloth table cloth upper portion is made of thin sheet plastic and the trash bag trash bag lower portion is made of thin sheet plastic.

3. The combination as described in claim 1 wherein the first pull strings are received inside heat sealed seams disposed along the sides of the length and width of the table cloth upper portion.

4. The combination as described in claim 1 wherein the second pull strings are received inside heat sealed seams disposed along the sides of the bag opening.

5. The combination as described in claim 1 wherein the table cloth upper portion includes decorative designs thereon for providing a festive look for birthday parties, picnics, anniversary, and other fun events.

6. The combination as described in claim 1 wherein the length of the table cloth upper portion is in a range of 6 to 8 feet and the width of the table cloth upper portion is in a range of 4 to 6 feet.

7. The combination as described in claim 1 wherein a length of the elongated bag opening is in a range of 2 to 4 feet.

8. A table cloth and trash bag combination adapted for receipt on a table and receiving trash items therein after a meal, picnic or party is finished, the combination comprising:

a thin sheet, plastic table cloth upper portion, a length and a width of the table cloth upper portion adapted for covering the table;

first pull strings, a first portion of the first pull strings extending outwardly from corners of the table cloth upper portion, a second portion of the first pull strings received inside heat sealed seams, the seams disposed along sides of the length and the width of the table cloth upper portion;

a thin sheet, plastic folded trash bag lower portion, the trash bag lower portion having an elongated bag opening in a top thereof, the bag opening centered on the table cloth upper portion, sides next to the bag opening attached to the table cloth upper portion;

whereby when corners of the table cloth upper portion are lifted upwardly, the elongated bag opening provides access into an unfolded trash bag lower portion for receiving trash items therein, whereby when the first pull strings are pulled tight, the trash items are held therein; and second pull strings, a first portion of the second pull strings extending outwardly from opposite ends of the trash bag lower portion and next to the open top of the trash bag lower portion, a second portion of the second pull strings received inside heat sealed seams disposed next to the bag opening;

whereby when the table cloth upper portion with trash items thereon is lifted and received inside the trash bag lower portion, the second pull strings are pulled tight, thereby closing the top of the trash bag lower portion for disposal of the table cloth and trash bag combination.

9. The combination as described in claim 8 wherein the table cloth upper portion includes decorative designs thereon for providing a festive look for birthday parties, picnics, anniversary, and other fun events.

10. The combination as described in claim 8 wherein the length of the table cloth upper portion is in a range of 6 to 8 feet and the width of the table cloth upper portion is in a range of 4 to 6 feet.

11. The combination as described in claim 8 wherein a length of the elongated bag opening is in a range of 2 to 4 feet.

12. A table cloth and trash bag combination adapted for receipt on a table and receiving trash items therein after a meal, picnic or party is finished, the combination comprising:

a thin sheet, plastic table cloth upper portion, a length and a width of the table cloth upper portion adapted for covering the table, the width of the table cloth upper portion in a range of 4 to 6 feet and the length of the table cloth upper portion in a range of 6 to 8 feet;

first pull strings, a first portion of the first pull strings extending outwardly from corners of the table cloth upper portion, a second portion of the first pull strings received inside heat sealed seams, the seams disposed along sides of the length and the width of the table cloth upper portion;

a thin sheet, plastic folded trash bag lower portion, the trash bag lower portion having an elongated bag opening in a top thereof, the bag opening centered on the table cloth upper portion, sides next to the bag opening attached to the table cloth upper portion, the bag opening having a length in a range of 2 to 4 feet;

whereby when corners of the table cloth upper portion are lifted upwardly, the elongated bag opening provides access into an unfolded trash bag lower portion for receiving trash items therein, whereby when the first pull strings are pulled tight, the trash items are held therein; and second pull strings, a first portion of the second pull strings extending outwardly from opposite ends of the trash bag lower portion and next to the bag opening, a second portion of the second pull strings received inside heat sealed seams disposed along sides of the bag opening;

whereby when the table cloth upper portion with trash items thereon is lifted and received inside the trash bag lower portion, the second pull strings are pulled tight, thereby closing the top of the trash bag lower portion for disposal of the table cloth and trash bag combination.

13. The combination as described in claim 12 wherein the table cloth upper portion includes decorative designs thereon for providing a festive look for birthday parties, picnics, anniversary, and other fun events.

* * * * *